US007339954B2

(12) United States Patent
Futamata

(10) Patent No.: US 7,339,954 B2
(45) Date of Patent: Mar. 4, 2008

(54) MULTIPLEXING DIGITAL BROADCAST METHOD THAT CAN ESTABLISH A TECHNIQUE WHICH CAN PERFECTLY OBTAIN A MULTIPLEXING DIGITAL BROADCAST DATA

(75) Inventor: Hideharu Futamata, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1305 days.

(21) Appl. No.: 10/128,435

(22) Filed: Apr. 24, 2002

(65) Prior Publication Data

US 2003/0108068 A1 Jun. 12, 2003

(30) Foreign Application Priority Data

Apr. 25, 2001 (JP) ..... 2001-127664

(51) Int. Cl.

| | |
|---|---|
| ***H04J 3/04*** | (2006.01) |
| ***H04N 5/92*** | (2006.01) |
| ***H04N 5/93*** | (2006.01) |
| ***H04N 7/12*** | (2006.01) |
| ***H04N 7/64*** | (2006.01) |

(52) U.S. Cl. ..... 370/486; 370/535; 348/423; 386/98; 386/112; 386/116; 725/118

(58) Field of Classification Search ..... 370/486, 370/535; 348/423; 386/98, 112, 116; 725/118
See application file for complete search history.

(56) References Cited

U.S. PATENT DOCUMENTS 4,829,524 A * 5/1989 Yoshida ..... 714/748
5,027,356 A * 6/1991 Nakamura et al. ..... 714/748
5,648,960 A * 7/1997 Sakazaki et al. ..... 370/498
5,734,780 A * 3/1998 Ichiura et al. ..... 386/46
5,867,207 A * 2/1999 Chaney et al. ..... 725/54
5,990,881 A * 11/1999 Inoue et al. ..... 715/720

(Continued)

FOREIGN PATENT DOCUMENTS

EP 0 434 228 A1 11/1990

(Continued)

OTHER PUBLICATIONS

United Kingdom Search Report dated Nov. 26, 2002.

(Continued)

*Primary Examiner*—Alpus H. Hsu
(74) *Attorney, Agent, or Firm*—McGinn IP Law Group, PLLC

(57) ABSTRACT

A multiplexing digital broadcast system includes a receiving terminal; and a broadcasting station. The receiving terminal includes: a receiving side recording device demodulating a specification digital data selectively specified from a multiplexing digital data transmitted by the broadcasting station to record; a receiving side table recording a position in a data string corresponding to a data unit of the specification digital data in which a demodulation ended in failure; and a communicating device transmitting the position in the data string to the broadcasting station, and wherein the broadcasting station includes: a broadcasting station side recording device recording an original data corresponding to the multiplexing digital data; and a supplemental data transmitting device extracting the specification digital data corresponding to the position in the data string from the original data to transmit to the receiving terminal.

16 Claims, 12 Drawing Sheets

U.S. PATENT DOCUMENTS

| | | | | |
|---|---|---|---|---|
| 6,130,898 | A * | 10/2000 | Kostreski et al. | 370/522 |
| 6,321,025 | B1 * | 11/2001 | Owashi et al. | 386/83 |
| 6,344,878 | B1 * | 2/2002 | Emura | 348/460 |
| 6,442,328 | B1 * | 8/2002 | Elliott et al. | 386/46 |
| 6,442,330 | B2 * | 8/2002 | Yanagihara et al. | 386/75 |
| 6,456,783 | B1 * | 9/2002 | Ando et al. | 386/125 |
| 6,580,869 | B1 * | 6/2003 | Ando et al. | 386/68 |
| 6,668,022 | B1 * | 12/2003 | Kim | 375/240.27 |
| 6,751,402 | B1 * | 6/2004 | Elliott et al. | 386/83 |
| 6,757,478 | B2 * | 6/2004 | Owashi et al. | 386/46 |
| 6,993,248 | B1 * | 1/2006 | Kato | 386/69 |
| 7,006,757 | B2 * | 2/2006 | Ando et al. | 386/94 |
| 2001/0015986 | A1 * | 8/2001 | Sugimoto et al. | 370/487 |
| 2003/0099457 | A1 * | 5/2003 | Takahashi et al. | 386/46 |

FOREIGN PATENT DOCUMENTS

| | | | |
|---|---|---|---|
| EP | 0 876 023 | A1 | 11/1998 |
| JP | 2-39142 | | 9/1990 |
| JP | 5-130355 | | 5/1993 |
| JP | 5-219056 | | 8/1993 |
| JP | 6-224863 | | 8/1994 |
| JP | 9-46648 | | 2/1997 |
| JP | 9-238292 | | 9/1997 |
| JP | 10-243372 | | 9/1998 |
| JP | 10-257001 | | 9/1998 |
| JP | 11-112981 | | 4/1999 |
| JP | 11-136648 | | 5/1999 |
| JP | 11-313061 | | 11/1999 |
| JP | 2000-232423 | | 8/2000 |
| JP | 2002-84239 | | 3/2002 |
| WO | WO 02/23791 | A2 | 3/2002 |
| WO | WO 02/058392 | A1 | 7/2002 |

OTHER PUBLICATIONS

English Translation of the Chinese Office Action dated Dec. 19, 2003.

Japanese Office Action dated May 6, 2005, with partial English translation.

* cited by examiner

MULTIPLEXING DIGITAL BROADCAST METHOD THAT CAN ESTABLISH A TECHNIQUE WHICH CAN PERFECTLY OBTAIN A MULTIPLEXING DIGITAL BROADCAST DATA

BACKGROUND OF THE INVENTION

1. Field of the Invention

The present invention relates to a multiplexing digital broadcast method. More particularly, the present invention relates to a multiplexing digital broadcast method of broadcasting or re-broadcasting a data except an original broadcast program data such as a data after a failure in a demodulation.

2. Description of the Related Art

In a digital broadcast, the importance with regard to the recording of its broadcast data is high. A digital broadcast receiver for receiving a digital broadcast data includes a recording/playback apparatus. The digital broadcast receiver is known from Japanese Laid Open Patent Application (JP-A-Heisei 9-238292). In such a digital broadcast receiver, as shown in FIG. 1, when only a particular program is selected from a plurality of digital broadcast programs and it is recorded, if a selection signal 101 of a user is input from an input device 102 through a user operation and one program is selected from indicated program menus, a system controller 103 obtains the video and audio constituting the selected program and an ID number of the other data from a program specification information of a program specification analyzer 104, and the ID number is given to a de-multiplexer 105. If the influences of a weather condition and the like cause a tuner 106 to fail in the reception of a broadcast electric wave, a signal output from the tuner 106 is lost. Thus, a digital demodulation error corrector 107 can not carry out such kind of demodulation. Consequently, there is no input signal in the de-multiplexer 105. Or, illegal data is input to the de-multiplexer 105. The de-multiplexer 105 can not send only a particular unit data of the selected program to branching device 108. Thus, a data group that ought to be sent through the branching device 108 to a record assistance processor 109 is not input to the record assistance processor 109. Hence, there is no data group to be sent to the record assistance processor 109. Or, the data group sent to the record assistance processor 109 is constituted by the illegal data. The processed video and audio and the other data are not normally transmitted to a D/IF (digital interface) 110 on a side of the recording/playback apparatus. So, nothing is recorded on a recording/playback apparatus 111. Or, the illegal data is recorded on the recording/playback apparatus 111. If the data recorded on the recording/playback apparatus 111 is input through a switch 112 to the de-multiplexer 105, a part of the data is lost, or the data is illegal. Hence, the part is not normally decoded by a decoder 113. Thus, the program can not be perfectly playback.

In this known apparatus, if the undesirable change of an environment such as a weather condition brings about the failure in the reception of a part of a broadcast program, one or a plurality of multiplexed digital broadcast data streams are recorded on the recording/playback apparatus in the failure state. Thus, the user can not playback the perfect program broadcast.

In a field of a communication, if a reception of data is unsuccessful, the re-transmission of the data is typically carried out. Japanese Laid Open Patent Application (JP-A-Heisei 6-224863) discloses a communication technique of re-transmitting the data if the reception of the data is unsuccessful. This known technique does not disclose the data obtainment through the re-transmission of the lost data at all if there is no signal input to the de-multiplexer or if an illegal signal is input to the de-multiplexer. It is requested to establish the technique that can perfectly obtain the multiplexing digital broadcast data. Moreover, it is desired to effectively carry out the perfect obtainment of the multiplexing digital broadcast data.

Japanese Laid Open Patent Application (JP-A-Heisei 11-313061) discloses the following data distribution center apparatus. In this data distribution center apparatus, a reception error detector detects a transmission error of a broadcast data received through a broadcast data block receiver. If there is the transmission error, a probably re-transmission request instructor probably carries out a re-transmission request so as to avoid the concentration of the re-transmission requests. On the other hand, a re-transmission request terminal size estimator estimates the number of terminals requesting the re-transmissions. If the number is small, they are individually transmitted by a particular block transmitter. If the estimated number of the terminals is large, a re-broadcast interruption processor re-broadcasts a broadcast data.

Japanese Laid Open Patent Application (JP-A 2000-232423) discloses the following communication apparatus. In this communication apparatus, a content signal of a popular program is broadcasted in advance to a terminal apparatus from a broadcast base station, and it is stored in a memory. In the terminal apparatus, if a content signal specified by a playback instruction signal is stored in the memory, the content signal is read out from the memory. On the other hand, if it is not stored in the memory, the terminal apparatus requests the specified content signal through a cellular network to a cellular base station, and receives the specified content signal.

Japanese Laid Open Patent Application (JP-A-Heisei 10-243372) discloses the following information transmission method. In this information transmission method, CPU in a terminal apparatus, if judging that there is a reception error when information of a frame unit transmitted from a host apparatus is received, stores in RAM the serial number of the frame, and enters a pseudo information into the frame having the reception error, and stores it in HDD. Then, after the connection through a modem and a public line to the host apparatus, the reception error information specifying the serial number is transmitted. After that, the information corresponding to a part of the reception error is received through the public line and the modem, and it is overwritten onto the corresponding frame.

Japanese Laid Open Patent Application (JP-A-Heisei 11-112981) discloses the following transmitting apparatus. In this transmitting apparatus and its method, when a specified part of a video signal based a re-transmission request from a receiving side is re-transmitted to the receiving side, if a temporal interval of the specified part is within a predetermined time, the specified part is collectively re-transmitted to the receiving side. Also in this transmitting apparatus and its method, the transmission side re-transmits the specified part of the video signal to the receiving side, in accordance with the re-transmission request done by the receiving side, and collectively re-transmits the specified part to the receiving side, if the temporal interval of the specified part at this time is within the predetermined time.

Japanese Laid Open Patent Application (JP-A-Heisei 11-136648) discloses the following data broadcast receiver. This data broadcast receiver has a supplementing unit for supplementing the information that could not be received, by using the already accurately received broadcast data, without updating all data file groups constituting a repeatedly broadcasted data broadcast program, for each broadcast of the program.

Japanese Laid Open Patent Application (JP-A-Heisei, 10-257001) discloses the following information transmission method. In this information transmission method, when data is transmitted from a host apparatus to a terminal apparatus, it is firstly multiplexed with a satellite broadcast wave through a satellite line, and it is transmitted. Thus, a merit of a simultaneous transmission of a large capacity of data can be obtained depending on a broadcast type. Then, the treatment for a case when a reception error occurs in the terminal apparatus is carried out as follows. Each terminal apparatus detects an error for each information of a frame unit, and uploads to the host apparatus the reception result indicative of a presence or absence of the error for each information. The host apparatus preferentially re-transmits the information having many error detection to the side of the terminal apparatus, in accordance with the reception result uploaded from each terminal apparatus.

Japanese Laid Open Patent Application (JP-A-Heisei 2-39142) discloses the following re-transmission control method. The feature of this re-transmission control method lies in the re-transmission control method of carrying out a data transmission through a relay station installed in an artificial satellite by using a wireless communication line, including: a stage at which a transmitting station for transmitting data receives and monitors a fact that the data sent by the self-station is relayed and transmitted by the relay station; and a stage at which when a condition needing a re-transmission of the data is detected at the above-mentioned stage, a procedure equal to a procedure for re-transmitting the data in accordance with a request of the receiving station is used to voluntarily re-transmit the data.

SUMMARY OF THE INVENTION

The present invention is accomplished in view of the above mentioned problems. Therefore, an object of the present invention is to provide a multiplexing digital broadcast method that can establish a technique which can perfectly obtain a multiplexing digital broadcast data.

Another object of the present invention is to provide a multiplexing digital broadcast method that can establish a technique which can effectively obtain a multiplexing digital broadcast data.

In order to achieve an aspect of the present invention, a multiplexing digital broadcast system, includes: a receiving terminal; and a broadcasting station, and wherein the receiving terminal includes: a receiving side recording device demodulating a specification digital data selectively specified from a multiplexing digital data transmitted by the broadcasting station to record; a receiving side table recording a position in a data string corresponding to a data unit of the specification digital data in which a demodulation ended in failure; and a communicating device transmitting the position in the data string to the broadcasting station, and wherein the broadcasting station includes: a broadcasting station side recording device recording an original data corresponding to the multiplexing digital data; and a supplemental data transmitting device extracting the specification digital data corresponding to the position in the data string from the original data to transmit to the receiving terminal.

In this case, the supplemental data transmitting device multiplexes the specification digital data to re-broadcast.

Also in this case, the receiving terminal further includes: an input device through which a receiving side user inputs a signal, and wherein the signal includes: a signal to playback the specification digital data recorded on the receiving side recording device; and a selection signal to select the specification digital data.

Further in this case, the position in the data string corresponds to a timing position, and the timing position is noted on the receiving side table.

In this case, the timing position includes a start time when a supplement is started with a supplemental data that is the specification digital data transmitted from the supplemental data transmitting device and an end time when the supplement is ended with the supplemental data.

Also in this case, the receiving terminal further includes: an input device through which a receiving side user inputs a signal, and wherein the signal includes: a signal to playback the specification digital data recorded on the receiving side recording device; a selection signal to select the specification digital data; and a transmission start signal to start a transmission of a supplemental data that is the specification digital data transmitted from the supplemental data transmitting device, and wherein the broadcasting station sends the supplemental data based on the transmission start signal.

Further in this case, the receiving side table records the position in the data string of the specification digital data in which the demodulation ended in failure as a playback stop position to stop playback a data recorded on the receiving side recording device.

In this case, the receiving side table records a record position of a data recorded on the receiving side recording device to playback a supplemental data that is the specification digital data transmitted from the supplemental data transmitting device instead of playback the data recorded on the receiving side recording device.

Also in this case, the receiving side table records a record position of a data recorded on the receiving side recording device to playback a supplemental data that is the specification digital data transmitted from the supplemental data transmitting device instead of playback the data recorded on the receiving side recording device.

Further in this case, the timing position includes a start time when a supplement is started with a supplemental data that is the specification digital data transmitted from the supplemental data transmitting device and an end time when the supplement is ended with the supplemental data, and wherein when a timing information of a played back one of the data recorded on the receiving side recording device which is not a supplemental data that is the specification digital data transmitted from the supplemental data transmitting device corresponds to the start time, a read out position of the played back one is changed to the record position.

In this case, the timing position includes a start time when a supplement is started with a supplemental data that is the specification digital data transmitted from the supplemental data transmitting device and an end time when the supplement is ended with the supplemental data, and wherein when a timing information of a played back one of the data recorded on the receiving side recording device which is not a supplemental data that is the specification digital data transmitted from the supplemental data transmitting device corresponds to the end time, a read out position of the played back one is changed to the playback stop position.

In order to achieve another aspect of the present invention, a multiplexing digital broadcast method, includes:

demodulating a specification data selectively specified from a multiplexing digital broadcast data broadcasted by a broadcasting station on a receiving side to record; recording a position in a data string of the specification data in which the demodulating ended in failure on the receiving side; communicating the position in the data string to the broadcasting station; and re-broadcasting the specification data corresponding to the position in the data string to the receiving side by the broadcasting station.

In this case, the re-broadcasting includes:

extracting from a data received by the broadcasting station the specification data corresponding to the position in the data string transmitted from the receiving side; adding an ID to specify the receiving side and an ID to specify the specification data to the specification data; and inserting the specification data into a frequency band of the multiplexing digital broadcast data; and multiplexing the specification data.

In order to achieve still another aspect of the present invention, a multiplexing digital broadcast method, includes: providing a stream data; and multiplexing data except usual program data in the stream data to broadcast.

In this case, the data except the usual program data is a re-broadcast data that is not demodulated on the receiving side.

In order to achieve yet still another aspect of the present invention, a computer readable recording medium for recording a program for a process, includes: transmitting to a broadcasting source a position in a data string of a data except a usual program data of a specification digital data selectively specified from a digital data except usual program data multiplexed in a stream data to be broadcasted from the broadcasting source in which a demodulation ended in failure at a received side.

A multiplexing digital broadcast method according to the present invention is provided and systemized with a receiving terminal (10) and a broadcasting station (25). The receiving terminal (10) is composed of: a receiving side recording device (18) for recording a specification digital data selectively specified from a multiplexing digital data (3) transmitted by the broadcasting station (25); a receiving side table (23) for recording a position in a data string corresponding to a data unit of a specification digital data after a failure in a demodulation of the specification digital data; and a communicating device (22) for transmitting the position in the data string to the broadcasting station (25). The broadcasting station (25) is composed of: a broadcasting station side recording device (32) for recording an original data corresponding to the multiplexing digital data; and a supplemental data transmitting device (33) for extracting the specification digital data corresponding to the position in the data string from the original data, and inserting into a timing line when the multiplexing digital data is broadcasted, and then transmitting to the receiving terminal (10).

By recording the position in the data string corresponding to the data unit of the specification digital data after the failure in the demodulation, only the specification data after the failure in the demodulation, which is necessary for a user, is re-broadcasted. Thus, the re-broadcast of the supplemental data is made effective.

The supplemental data transmitting device (33) multiplexes the specification digital data and re-broadcasts it. The re-broadcast is also multiplexed, and the broadcast efficiency is further improved, and a cost of a facility investment is reduced, and a delay in an obtainment of the supplemental data is suppressed. Thus, the usage efficiency on the user side is improved.

The receiving terminal (10) further includes an input device (14) through which the receiving side user inputs a signal. The signal is composed of: a signal for playback the specification digital data recorded on the receiving side recording device (18); and a selection signal for selecting the specification digital data. Thus, the convenience of the user is excellent.

The string position in the data corresponds to the timing position. The timing position is noted on the receiving side table (23). The timing position is composed of a supplement start time and a supplement end time for the supplemental data that is the specification digital data transmitted from the supplemental data transmitter. The string position in the data physically corresponds to the timing position. The timing position and a spatial position of a recording medium of a recorder do not always correspond to each other, in a one-to-one relationship. The supplement start time and the supplement end time are recorded to thereby specify the recorded position of the received supplemental data. Thus, a series of data after the failure of the demodulation is determined.

The receiving terminal (10) further includes a transmission start signal to start the transmission of the supplemental data. The transmission start signal enables the user to obtain the supplemental data at a desired time band. In the broadcasting station (25), the transmission start signal is sent to the broadcasting station. The broadcasting station (25) sends the supplemental data based on the signal. Thus, the broadcast service is enriched.

On the receiving side table (23), the position in the data string of the specification digital data after the failure in the demodulation is recorded as a playback stop position to stop playback the data recorded on the receiving side recorder (18). If a position of a playback data coincides with the supplement start position during the playback of non-supplemental data, a position from which the supplemental data to be played back is read out is changed to a position on which the supplemental data is recorded. If the position of the supplemental data coincides with the supplement end position during the playback of the supplemental data, the position from which the supplemental data to be played back is read out is changed to the playback stop position. Thus, it is possible to automate the recording of a usual program data and the playback of the supplemental data.

The multiplexing digital broadcast method according to the present invention includes: a step at which a specification data selectively specified from a multiplexing digital broadcast data broadcasted by a broadcasting station is demodulated on a receiving side and recorded; a step at which a position in a data string of the specification data after a failure of a demodulation is recorded on the receiving side; a step at which the position in the data string is communicated to the broadcasting station; and a step at which the specification data corresponding to the position in the data string is re-broadcasted to the receiving side. The re-broadcasting step is composed of: a step of extracting from the data the specification data corresponding to the position in the data string transmitted from the reception terminal; a step of adding an ID for specifying the receiving side and an ID for specifying the specification data to the specification data; a step of inserting the specification data into a position row of the multiplexing digital broadcast data; and a step of multiplexing the specification data. Thus, the broadcast efficiency can be further improved.

The multiplexing digital broadcast method according to the present invention improves the broadcast efficiency by multiplexing data except usual program data in stream data and then broadcasting it. The data except the usual program data is especially preferably exemplified as a re-broadcast data that can not be demodulated on the receiving side. As for the specification data selectively specified from the multiplexing digital data broadcasted by such a broadcasting method, a recording medium for recording a program to transmit to a broadcast source the position in the data string of the usual program data that can not be demodulated by a user on the receiving side is detachably built in a receiver on the receiving side. Thus, it is possible to provide a service satisfying a desire of the user.

When a user of a digital broadcast receiver records a digital broadcast program on a recording/playback apparatus such as a hard disc or the like, if the digital broadcast receiver can not transiently receive a broadcast electric wave because of factors of a weather and the like and can not record a part of the program, the digital broadcast receiver transmits to a broadcasting station the information of the part that can not be received, and obtains a supplemental data sent from the broadcasting station on the basis of the information. Thus, a part of the stream data, which is stored in the recording/playback apparatus and can not be received, is supplemented. Hence, the user can look at and listen to all the broadcast programs.

DESCRIPTION OF THE PREFERRED EMBODIMENTS

An embodiment of the present invention will be described below with reference to the attached drawings.

Figure 1:
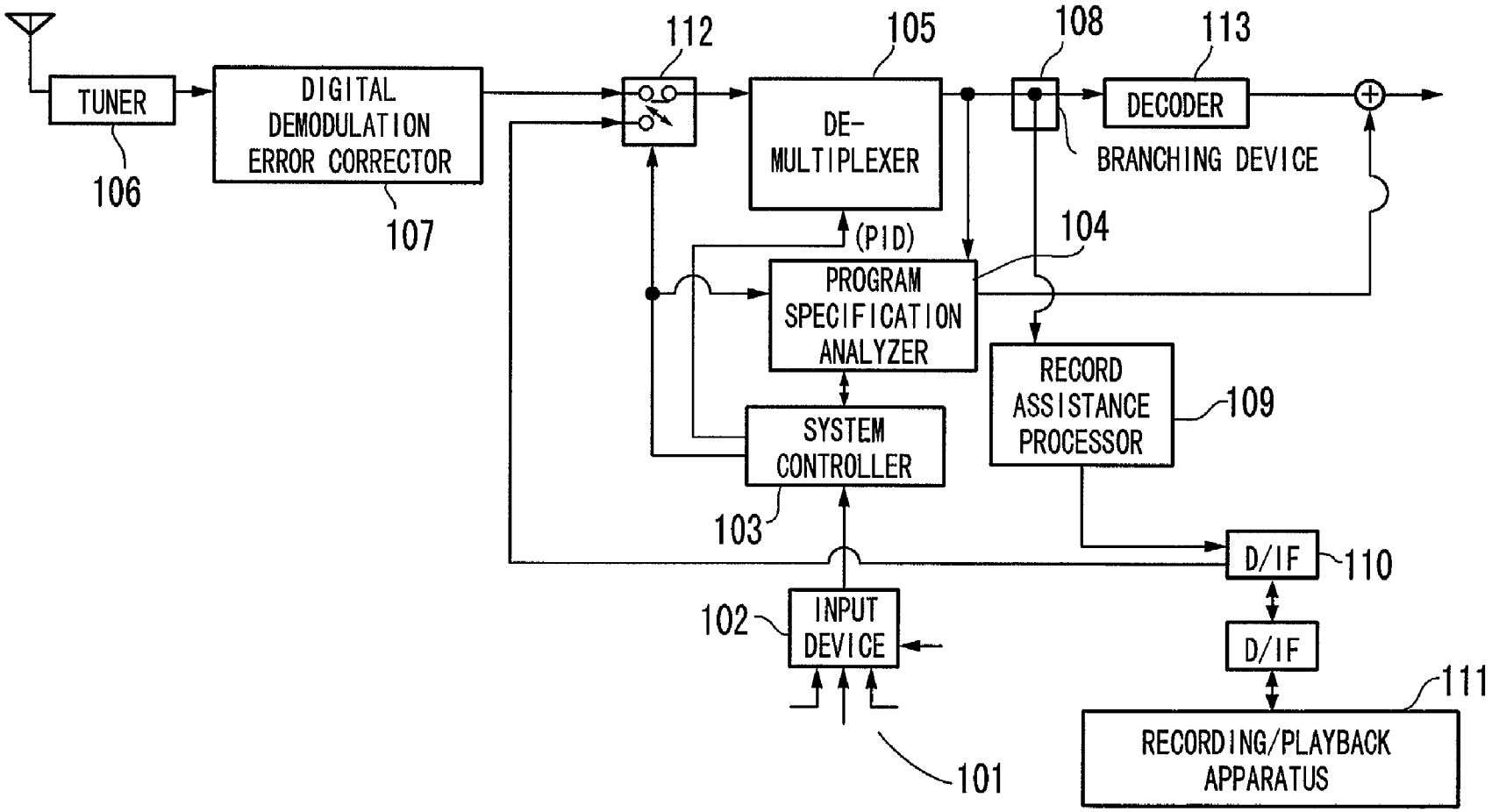
Fig. 1 PRIOR ART
FIG. 1 is a circuit block diagram showing a known system.
Figure 2:
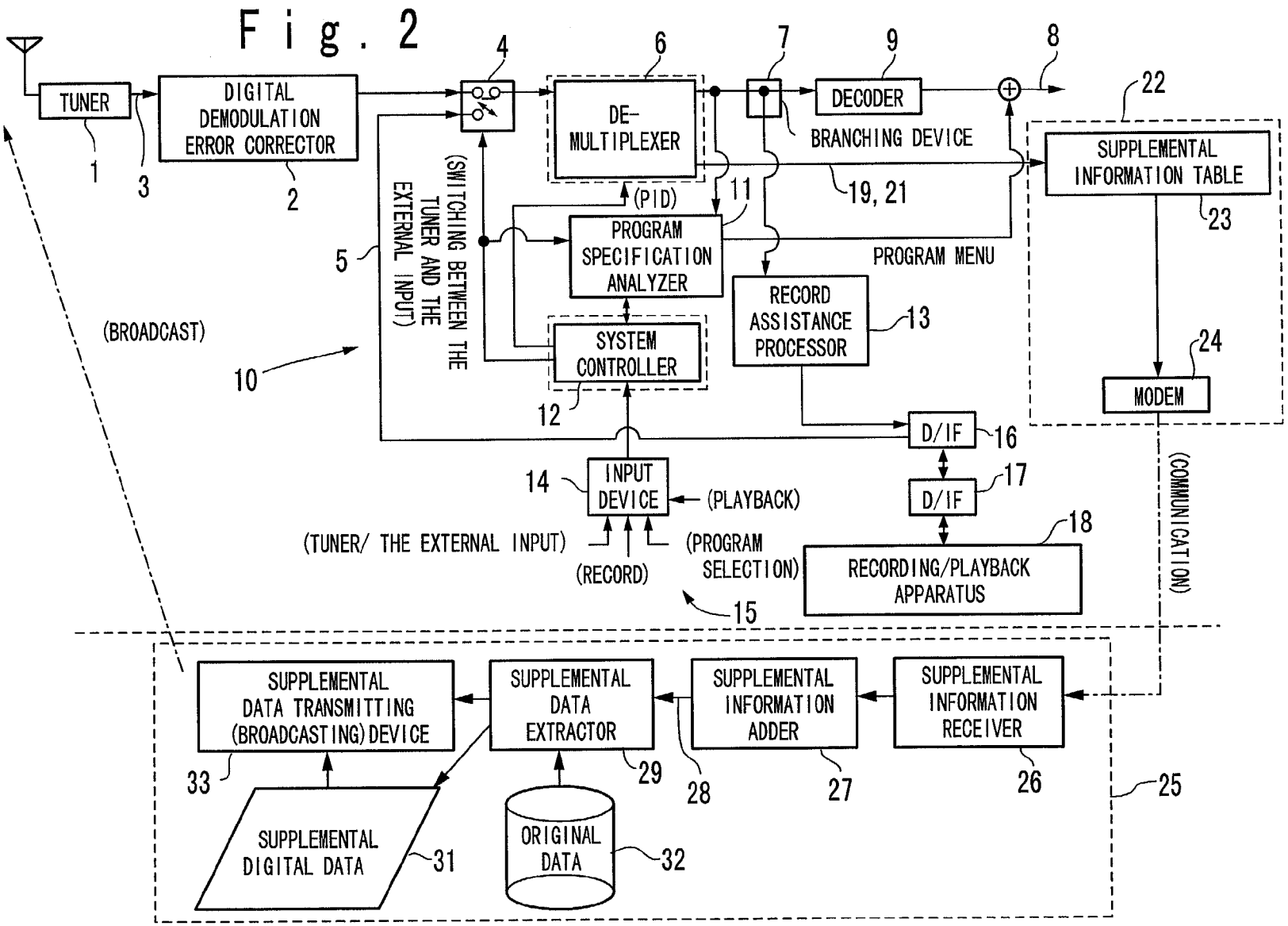
FIG. 2 is a circuit block diagram showing an embodiment of a multiplexing digital broadcast system according to the present invention.

An embodiment of a multiplexing digital broadcast system according to the present invention includes a receiving terminal together with a broadcasting station. Its receiving terminal 10 is provided with a tuner and a digital demodulation error corrector. As shown in FIG. 2, the tuner 1 receives a broadcast electric wave, which is transmitted by a broadcasting station, a broadcasting satellite and the like, on the basis of a selection of a desirable frequency. Broadcast data outputted by the tuner 1 is inputted to the digital demodulation error corrector 2. If an error correction can be carried out, the digital demodulation error corrector 2, while correcting its error at a time of a demodulation, and demodulates its digital data 3.

The digital demodulation error corrector 2 is connected to an input switch 4. The input switch 4 switches between the digital data 3 received from the digital demodulation error corrector 2 and an external input 5 received from a later-described recording/playback apparatus, and outputs it. The input switch 4 is connected to a de-multiplexer 6. The de-multiplexer 6 extracts an individual data for each program or an individual data for each information from the multiplexed digital data 3. The de-multiplexer 6 is connected to a branching device 7. The branching device 7 outputs the digital video and audio of the data extracted by the de-multiplexer 6 to an output side 8, or outputs to the side of the later-described recording/playback apparatus.

The branching device 7 is connected to a decoder 9. The decoder 9 expands compressed digital video and audio data. The de-multiplexer 6 is connected to a program specification analyzer 11. The program specification analyzer 11 analyzes a program specification information contained in the digital data 3. The program specification analyzer 11 is connected to a system controller 12 in two way directions. The system controller 12 includes therein a CPU (not shown) and a recording medium for recording a supplemental program, which is read in the CPU, for supplementing a digital broadcast data. Then, in accordance with an instruction received from an operator (user), it controls the input switch 4 and the de-multiplexer 6 in accordance with the supplemental program.

The branching device 7 is connected to a record assistance processor 13. The record assistance processor 13 assists in processing the information in recording a program. An input device 14 is connected to the system controller 12. The input device 14 sends an instruction 15 received from the operator to the system controller 12. The record assistance processor 13 is connected to a receiver side digital interface (D/IF) 16. The receiver side digital interface 16 is connected to a recording/playback apparatus 18 through a recording/playback apparatus side digital interface (D/IF) 17.

The digital demodulation error corrector 2, if it can not correct an error of the digital data 3 received from the tuner 1, records on a system memory 22, a first time information 19 corresponding to a time of an obtainment (input) of the digital data 3 normally inputted to the de-multiplexer 6 immediately before the failure in the demodulation of the digital data 3 and a second time information 21 corresponding to a time of an obtainment (input) of the digital data normally inputted to the de-multiplexer 6 in a case of a success in the demodulation of the digital data re-transmitted in the digital demodulation error corrector 2, and it generates a supplemental information table 23 composed of the first time information 19 and the second time information 21.

The system memory 22 has a modem 24. The modem 24 transmits the supplemental information table 23 recorded in the system memory 22 to a broadcasting station 25. The broadcasting station 25 has a supplemental information receiver 26 for receiving the supplemental information tables 23 transmitted from receivers of respective users. The supplemental information receiver 26 is connected to a supplemental information adder 27. The supplemental information adder 27 adds up the contents of the many supplemental information tables 23 received by the supplemental information receiver 26, and outputs an added up supplemental information 28.

The supplemental information adder 27 is connected to a supplemental data extractor 29. The supplemental data extractor 29 extracts a supplemental digital data 31 from an original data 32 of a broadcast program on the basis of the added up supplemental information 28, and generates it. The supplemental data extractor 29 is connected to a supplemental data transmitting (broadcasting) device 33. The supplemental data transmitting device 33 broadcasts the supplemental digital data 31, which is extracted from the original data 32 by the supplemental data extractor 29, by reserving a region in a multiplexing program for a broadcast data.

Figure 3:
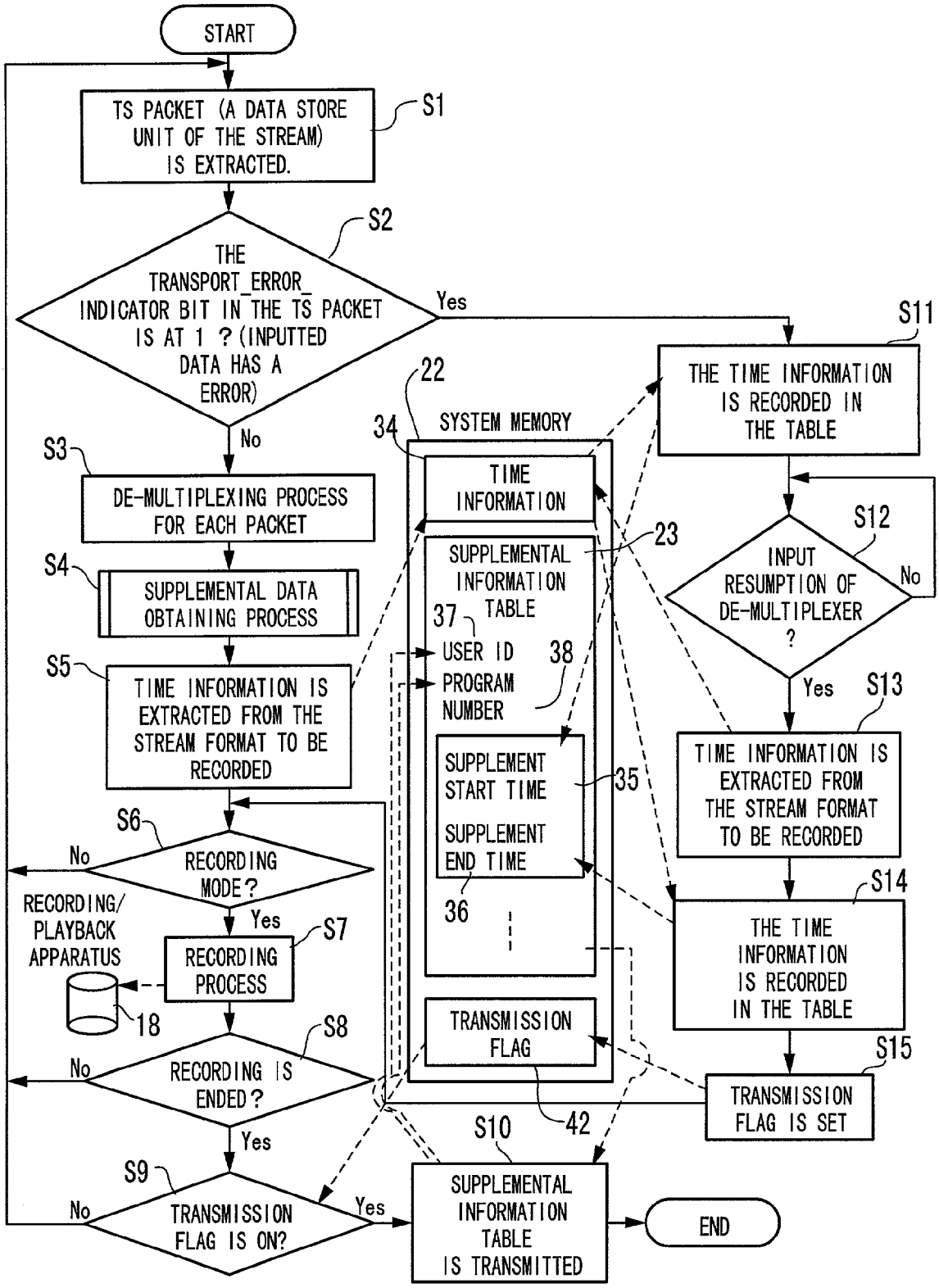
FIG. 3 is an operation flow showing an embodiment of a multiplexing digital broadcast method according to the present invention.

FIG. 3 shows a supplemental information generating method of generating the supplemental information table 23. In this embodiment, a type of a transport stream can be exemplified which is defined by Mpeg-ts (ISO/IEC 13818-1) as a broadcast data type for digital video and audio. If the de-multiplexer 6 can not receive a normal stream data, the de-multiplexer 6 generates the supplemental information table 23.

As shown in FIG. 3, the de-multiplexer 6 extracts a packet implying a data store unit of the transport stream at a packet extracting step S1. Then, if it detects that a transport_error_indicator bit defined as a bit indicative of the inclusion in a packet of a bit error which can not be corrected on the basis of the Mpeg-ts is not at 1 (indicative of non-existence of a bit error), it carries out a de-multiplexing process for each packet at a de-multiplexing step S3 and a supplemental data obtaining step S4. After that, it extracts a PTS/DTS (a data field defined as a field for storing therein the time information 19, 21 in the transport stream) at a time information recording step S5, and records a time (temporal) information 34 in a variable region on the system memory 22.

Next, if a recording mode is verified at a mode verifying step S6, the sequence proceeds to a recording step S7. If it is not the recording mode, the sequence again returns back to the packet extracting step S1. Here, the detail of the control process based on the recording mode has been typically known as a conventional process of a known VTR and the like. If the packet is recorded in the recording/playback apparatus 18 at the recording step S7 and the recording is ended at an end judging step S8 and a transmission flag is on (step S9), the supplemental information table 23 is transmitted (step S10). If the recording is judged to be not ended, the sequence again returns back to the step S1 in order to carry out the packet extracting process.

If the fact that the transport_error_indicator bit is at 1 (indicative of an existence of a bit error) is detected at the error judging step S2, the times 19, 21 corresponding to the respective packets are recorded in the supplemental information table 23 as the time information, at a supplement start time recording step S11. Finally, the time information 19 of the transport stream that is normally inputted is stored in a supplement start time column 35 of the supplemental information table 23. Next, this is repeated until the input of the packet in which the transport_error_indicator bit is at 0 (indicative of non-existence of a bit error) is detected at an input resumption judging step S12 (step S12). If the packet in which the transport_error_indicator bit is at 0 (indicative of non-existence of a bit error) is inputted, the PTS/DTS of the transport stream in which the input is resumed at a time information recording step S13 is recorded in the time information 34 of the supplemental information table 23. The second time information 21 is stored in a supplement end time column 36 of the supplemental information table 23.

In succession, at a flag setting step S15, the transmission flag is set. Then, the sequence proceeds to the mode judging step S6. If the recording mode is verified, the packet is recorded in the recording/playback apparatus 18 at the recording step S7. Then, the sequence proceeds to the end judging step S8. If the recording is judged to be ended at the end judging step S8, when the fact that the transmission flag is set is detected at the flag judging step S9, a user ID 37 and a program number 38 are set for the supplemental information table 23 at the supplemental information table transmitting step S10, and it is transmitted through the modem 24 to the broadcasting station 25. If the fact that the transmission flag is not set is detected at the flag judging step S9, the sequence again returns back to the packet extracting step S1.

Next, as shown in FIG. 2, on the side of the broadcasting station, if a plurality of supplemental information tables 23 transmitted together with the respective user IDs are received by the supplemental information receiver 26, they are added up by the supplemental information adder 27. Then, the start positions and the end positions of the partial stream data that can not be recorded are calculated with regard to all the users. The supplemental data extractor 29 extracts the thus-calculated stream data from the start positions to the end positions from the original data 32 of the broadcast program, and generates a new stream data as a supplemental data 31. At this time, the corresponding user ID is added as an addition information.

Figure 4:
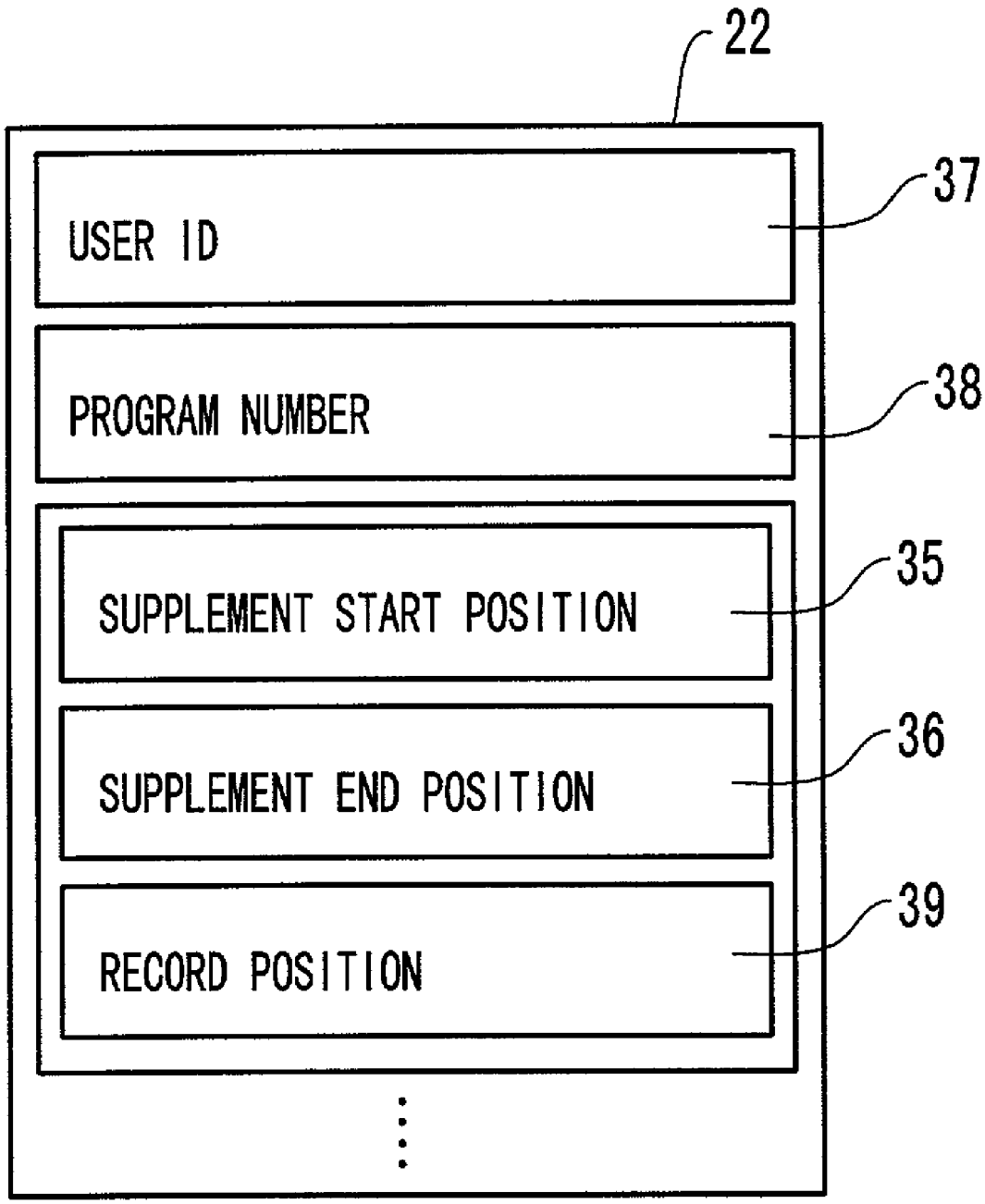
FIG. 4 is a table showing a position.

A packet ID peculiar to the supplemental data and the like are assigned to the generated supplemental data 31. Thus, it is transmitted as the packet data that can be identified as the supplemental data, after a band is reserved in a part of a multiplexing stream. FIG. 4 shows the supplemental information table 23 in detail. The supplemental information table 23 has an existing user ID 37, a program number 38, a supplement start position column 35 for keeping therein the supplement start time 19, a supplement end position column 36 for keeping therein the supplement end time 21, and a record position 39.

Figure 5:
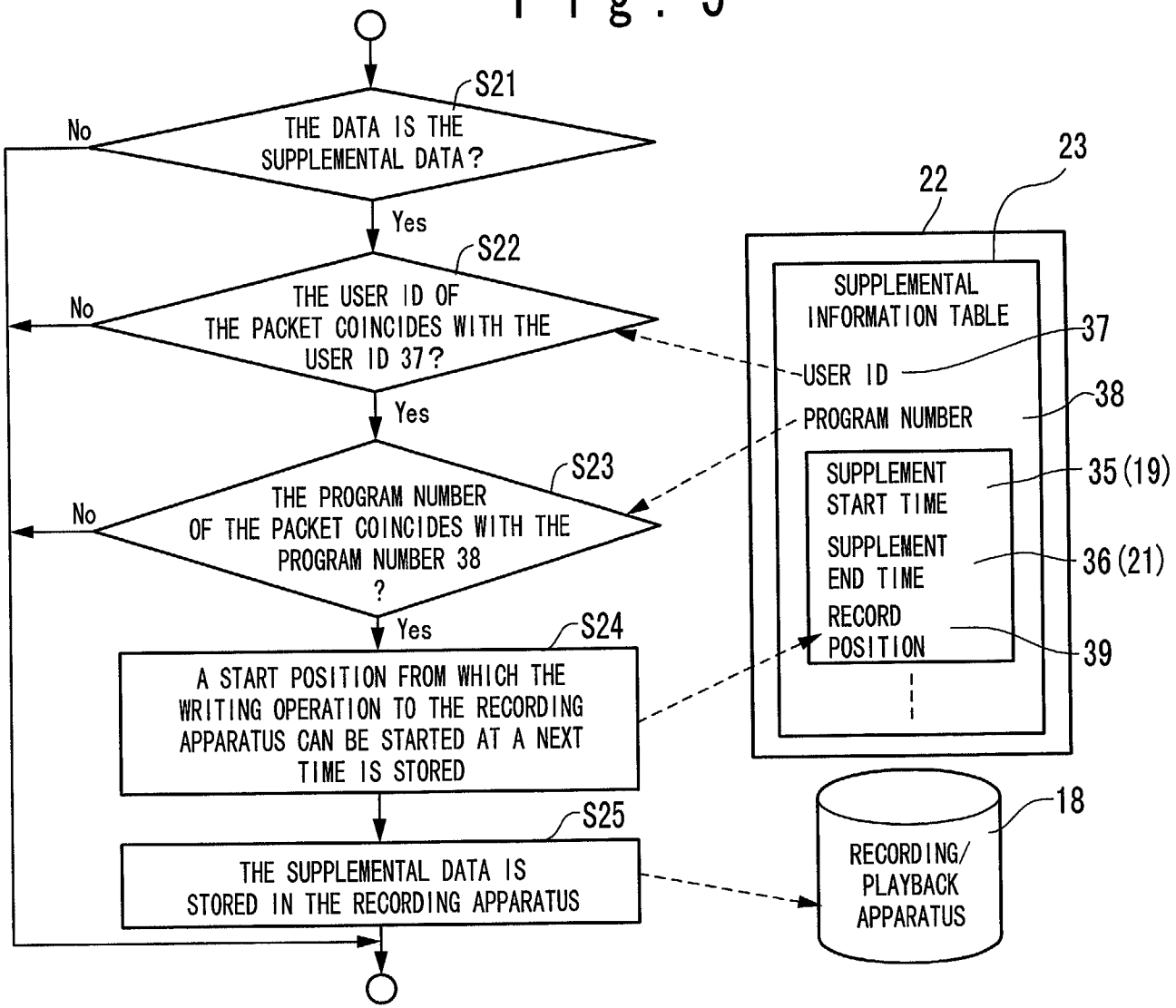
FIG. 5 is an operation flow showing another embodiment of a multiplexing digital broadcast method according to the present invention.

FIG. 5 shows the supplemental data obtaining step S4 shown in FIG. 3. If the fact that the data is the supplemental data is detected by verifying the packet ID 37 and the like at a packet type judging step S21, when at a user ID judging step S22, the user ID of the packet coincides with and corresponds to the user ID 37 set at the step S10, it is judged at a program number judging step S23 whether or not the program number of the packet coincides with the program number 38 of the supplemental information table 23. If they coincide with each other, a start position from which the writing operation to the recording/playback apparatus 18 can be started at a next time is stored in the record position 39 of the supplemental information table 23 at a record position judging step S24. After that, the data of the packet is recorded in the recording/playback apparatus 18 at a supplemental data recording step S25. If the respective judgments at the packet type judging step S21, the packet ID judging step S22 and the program number judging step S23 are at N, nothing is done in any case. Then, the process is ended.

Figure 6:
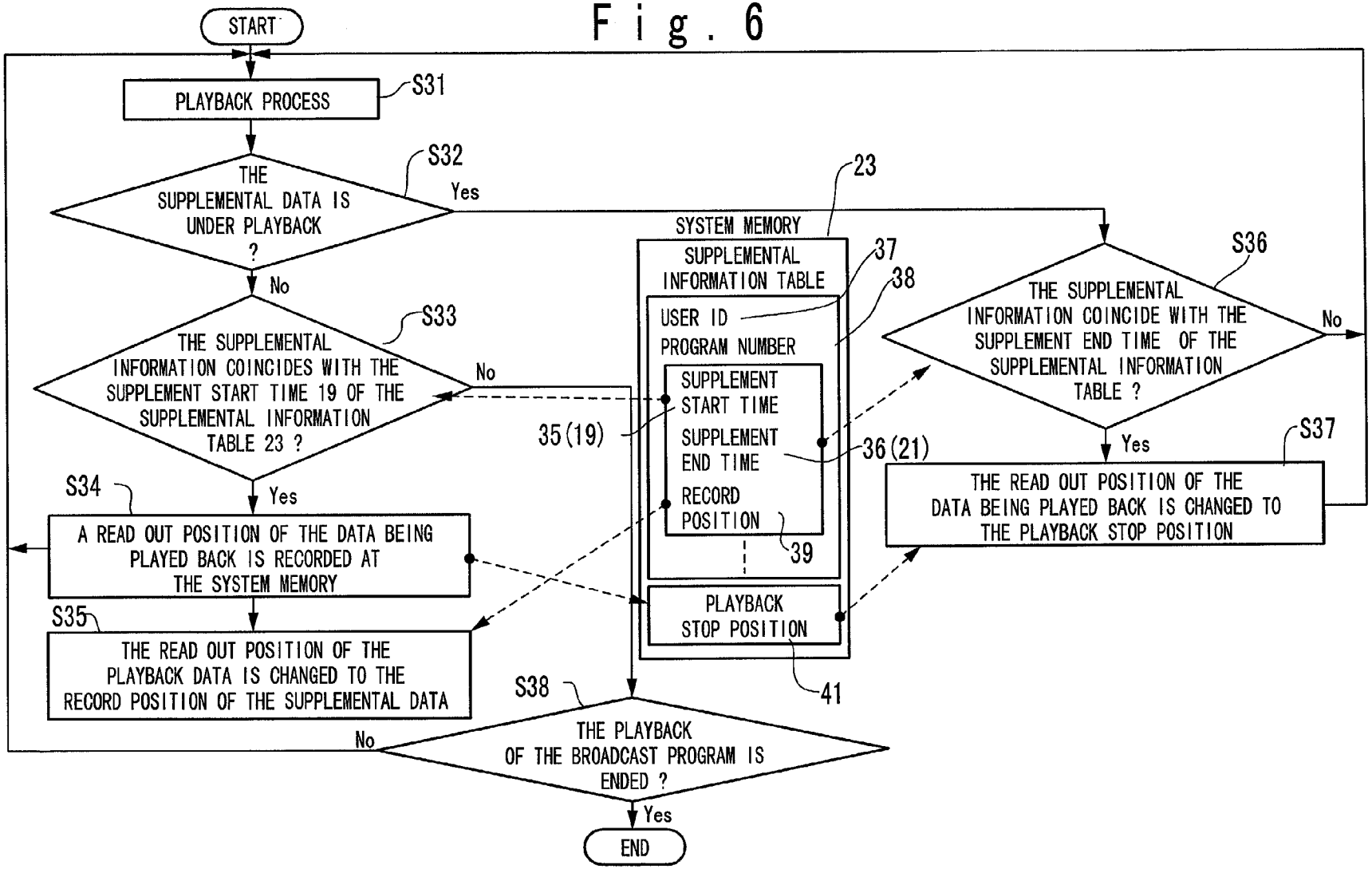
FIG. 6 is an operation flow showing still another embodiment of a multiplexing digital broadcast method according to the present invention.

FIG. 6 shows the process of the system controller 12 when the recorded program is played back after the obtainment of the supplemental data 31. If the usual playback is carried out by the recording/playback apparatus 18 at a playback step S31, the fact that the data being played back is not the supplemental data 31 is detected at a supplement operation judging step S32, and the fact that the time information (PTS/DTS) of the data being played back coincides with the supplement start time 19 of the supplemental information table 23 is detected at a supplement start time judging step S33, a read out position of the data being played back is recorded at a playback stop position 41, which is a variable region of the system memory 22, at a playback stop position recording step S34. The read out position of the playback data is changed to the record position 39 (refer to FIG. 4) of the supplemental table 23, at a playback-switching step S35. Then, the sequence returns back to the playback step S31.

If the data being played back at the playback step S31 is the supplemental data 31 at the supplement operation judging step S32, when the fact that the time information (PTS/DTS) of the data being played back coincides with the supplement end time 21 of the supplemental information table 23 is detected at a supplement end time judging step S36, the read out position of the data being played back is changed to the playback stop position 41 that is the variable region on the system memory at a playback data changing step S37, and the sequence returns back to the playback step S31.

If the time information (PTS/DTS) of the data being played back does not coincide with the supplement end time 21 of the supplemental information table 23 at the supplement end time judging step S36, nothing is done, and the sequence returns back to the playback step S31. If the time information (PTS/DTS) of the data being played back does not coincide with the supplement start time 19 of the supplemental information table 23 at the supplement start time judging step S33, it is judged at a playback end judging step S38 whether or not the playback of the recorded program is ended. If it is not ended, the sequence returns back to the playback step S31. If it is ended, the playback of the recorded program is ended.

Such a series of processes enables the perfect supplement of the part of the broadcast program that could not be recorded because of the failure in the reception. Thus, it is possible to playback the entire broadcast program.

Figure 7:
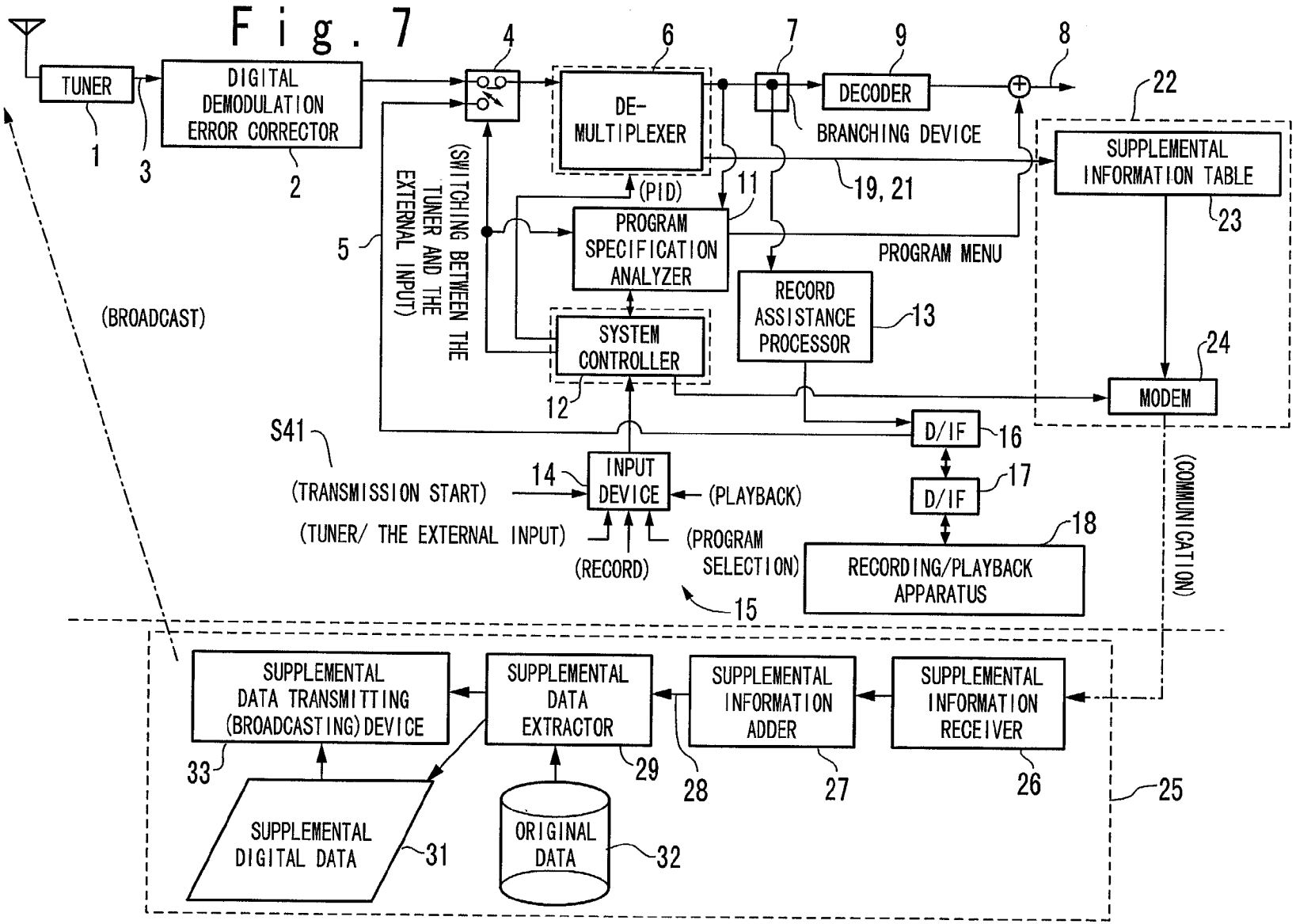
FIG. 7 is a circuit block diagram showing another embodiment of a multiplexing digital broadcast system according to the present invention.

FIG. 7 shows another embodiment of a multiplexing digital broadcast system according to the present invention. This embodiment differs from the above-mentioned embodiment in that an input of a transmission start is added as a signal to be inputted to the input device 14, the flag judging step S9 shown in FIG. 3 and the supplemental information table transmitting step S10 are removed from a method of generating a supplemental information table shown in FIG. 8, and a flag judging step S42 and a supplemental information table transmitting step S43 are added at a supplemental information table transmitting step A1 through a manual input shown in FIG. 9, as the process of the system controller 12 with regard to the existing input of the transmission start signal to the input device 14.

Figure 9:
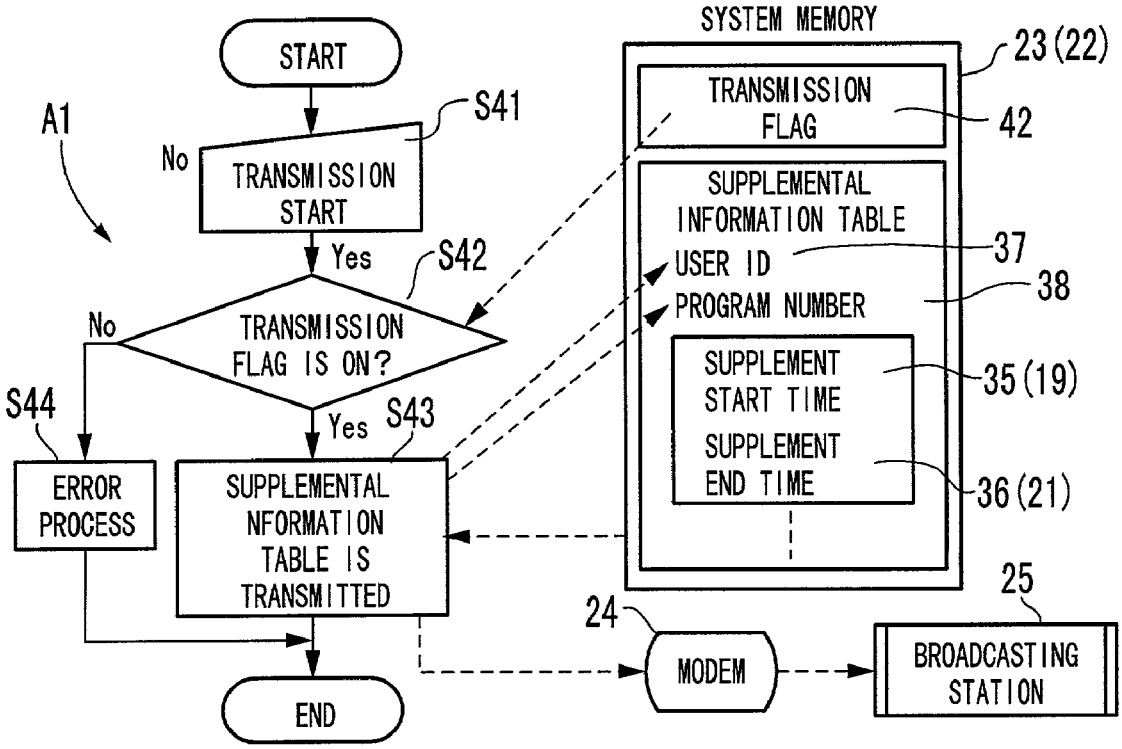
FIG. 9 is an operation flow showing still another embodiment of a multiplexing digital broadcast method according to the present invention.

The flag judging step in this embodiment is not carried out immediately after the judgment of the end of the recording at the end judging step S8 shown in FIG. 3, and it is done immediately after the input of the transmission start (step S41) through the manual input, as shown in FIG. 9. A supplemental information table transmitting step S43 instead of the supplemental information table transmitting step S10 in FIG. 3 is carried out if the transmission flag is judged to be ON at a flag judging step S43.

If the de-multiplexer 6 verifies that a normal stream data could not be inputted, the supplemental information table 23 is generated. In the embodiment shown in FIG. 3, the flag judging step and the supplemental information table transmitting step are not carried out immediately after the recording is judged to be ended at the end judging step S8, for the process for generating the supplemental information table 23 shown in FIG. 4 in the de-multiplexer 6. Thus, the supplemental information table 23 is not transmitted to the broadcasting station 25.

Figure 8:
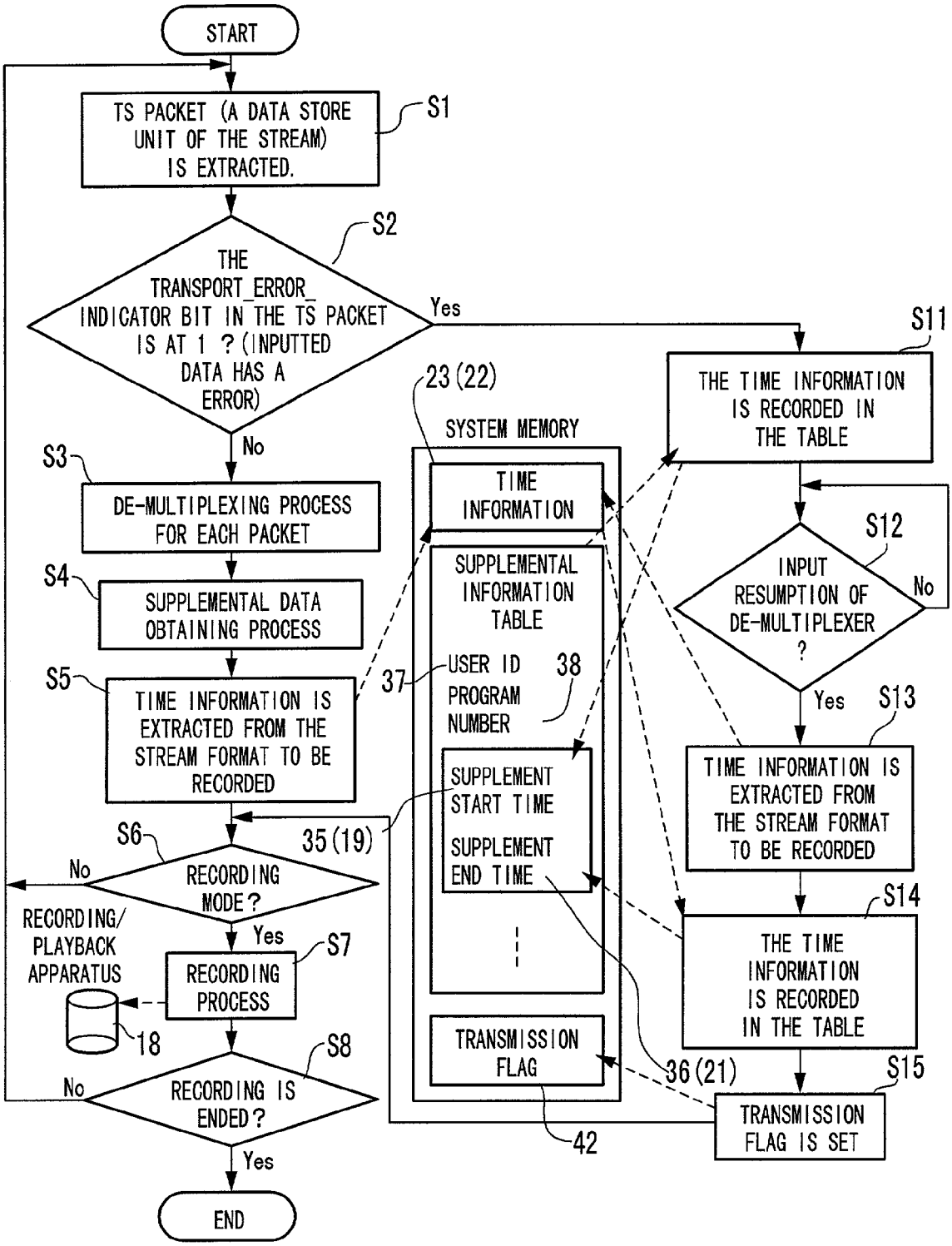
FIG. 8 is an operation flow showing still another embodiment of a multiplexing digital broadcast method according to the present invention.

After the supplemental information table 23 is generated in the system memory 22 by the series of the processes shown in FIG. 8, if the manual input of the transmission start is performed on the input device 15 shown in FIG. 7 at a step S41, the system controller 12 carries out the supplemental information table transmitting step A1 through the manual input. As shown in FIG. 9, the input of the transmission start causes the flag judging step S42 to be carried out. Then, if the fact that a transmission flag 42 of the system memory 22 is set for the supplemental information table 23 is detected, the user ID 38 and the program number 39 are set for the supplemental information table 23 at a supplemental information table transmitting step S43, and they are transmitted through the modem 24 to the broadcasting station 25. If the fact that the transmission flag 42 is OFF is detected at the flag judging step S42, an error process, such as a report of an error to the user and the like, is carried out at an error processing step S44. Then, the supplemental information table transmitting step A1 through the manual input is ended.

Figure 10:
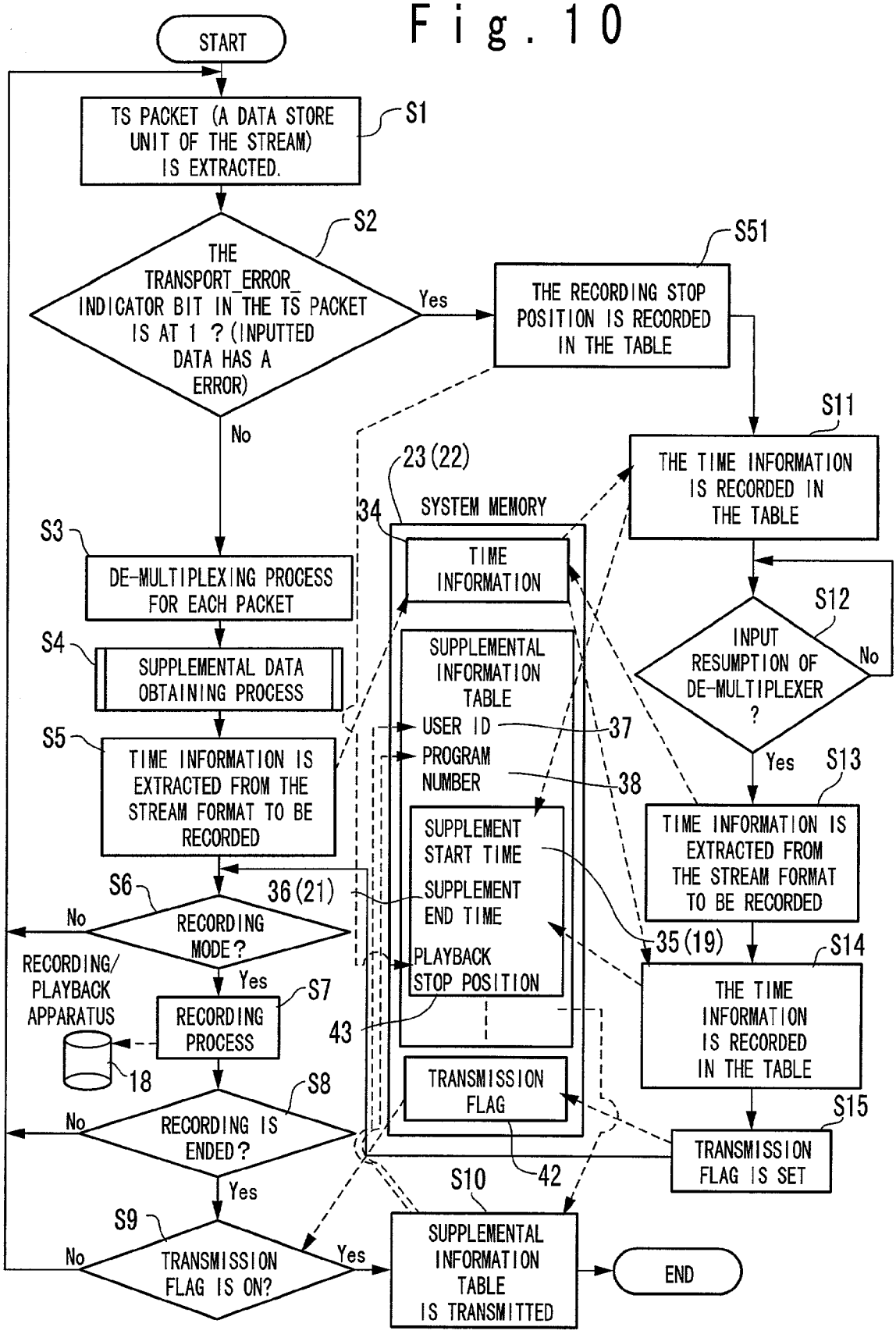
FIG. 10 is an operation flow showing still another embodiment of a multiplexing digital broadcast method according to the present invention.
Figure 11:
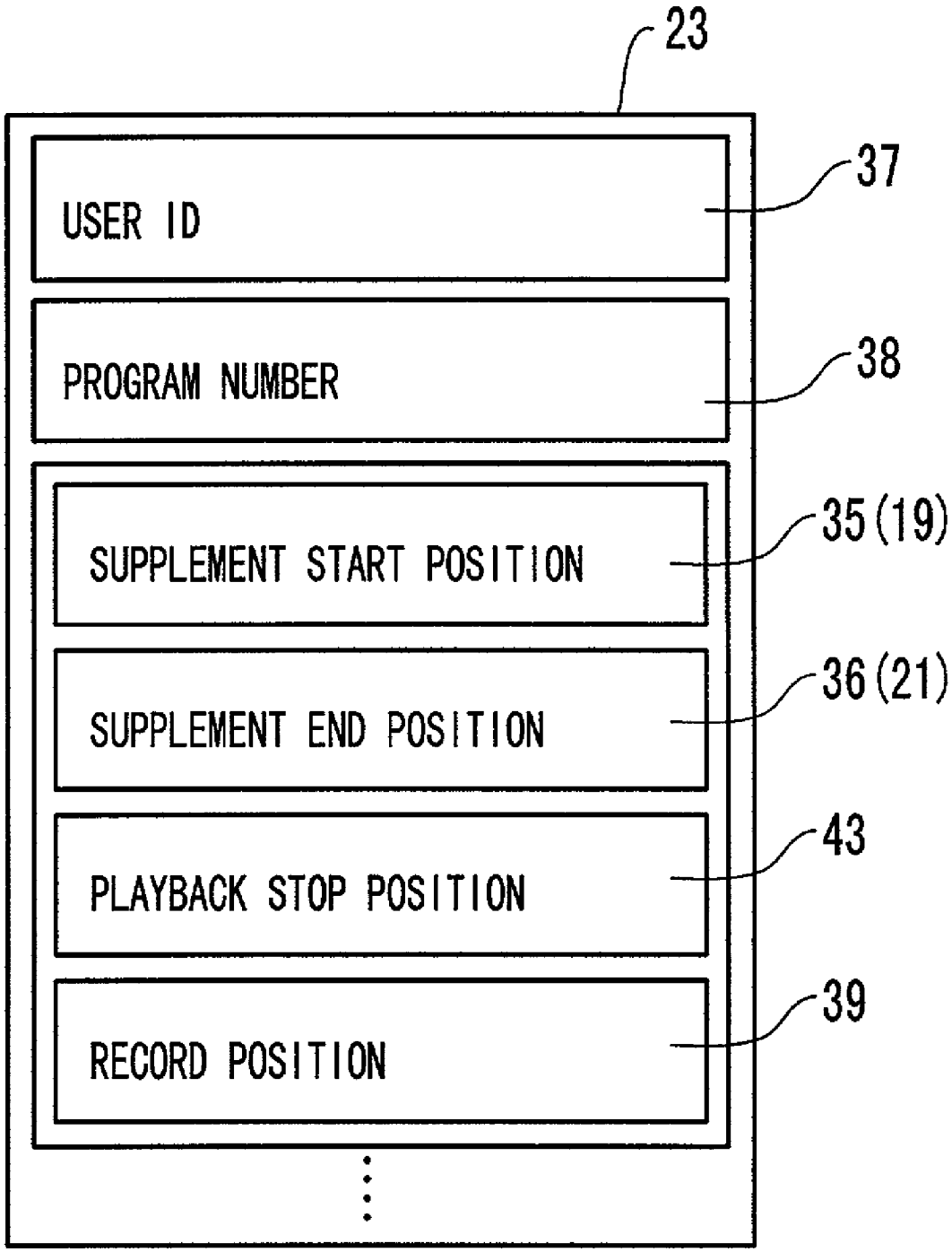
FIG. 11 is a table showing a position.

FIG. 10 shows still another embodiment of a multiplexing digital broadcast method according to the present invention. A recording stop position recording step S51 is added to the supplemental information table generating step shown in FIG. 3, as mentioned above. The recording stop position recording step S51 is temporally inserted between the error judging step S2 and the supplement start time recording step S11. As shown in FIG. 11, a playback stop position 43 is added to a supplemental information table 23 instead of the supplemental information table 23 of the above-mentioned embodiment shown in FIG. 3.

Figure 12:
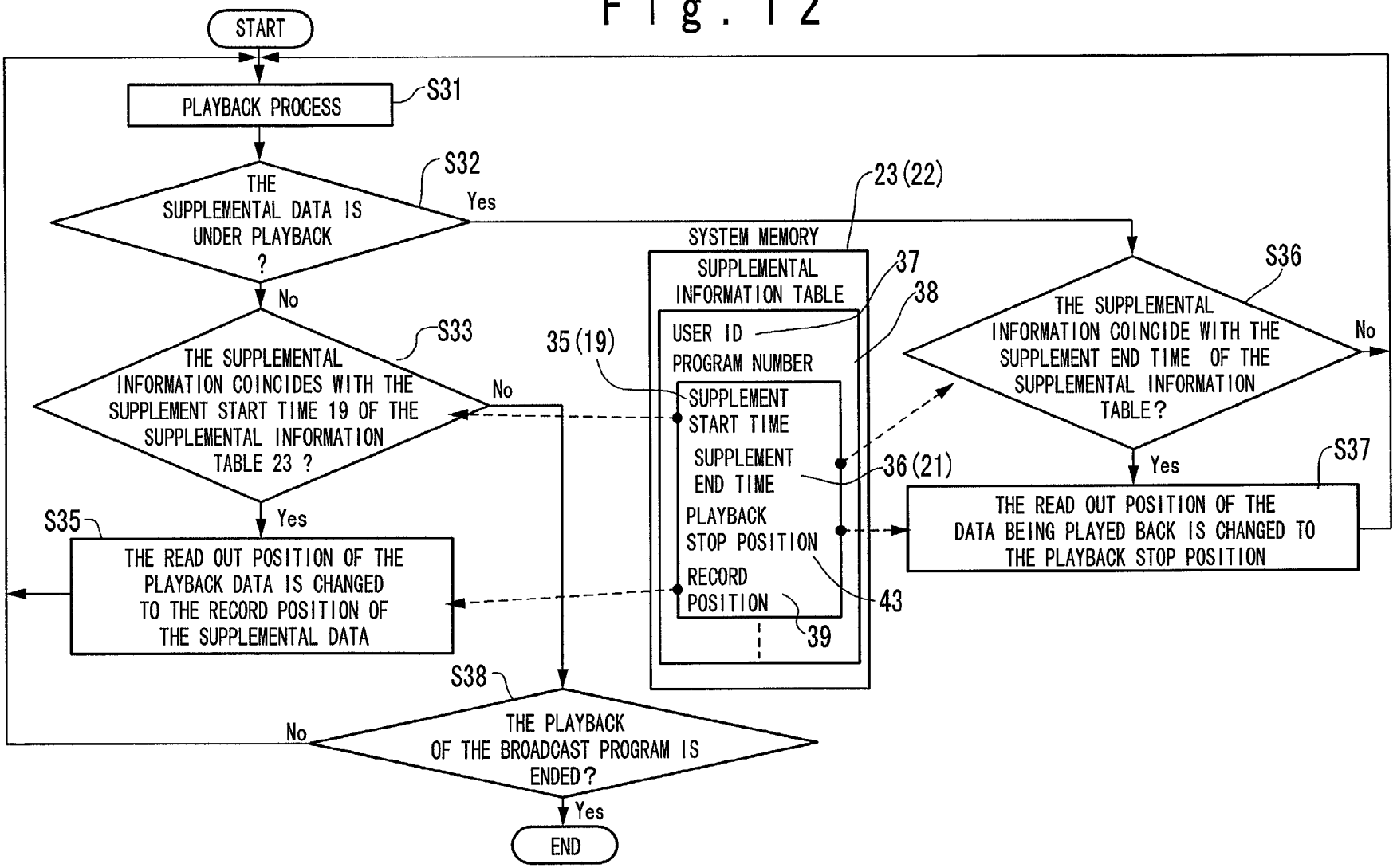
FIG. 12 is an operation flow showing still another embodiment of a multiplexing digital broadcast method according to the present invention.

As shown in FIG. 12, the supplemental data playback process in this embodiment differs from the supplemental data playback process shown in FIG. 6 in that the playback stop position recording step S34 in FIG. 6 is omitted and the playback stop position 41 of the supplemental information table 23 is omitted. If the fact that the time information (PTS/DTS) of the data being played back coincides with the supplement start time 19 of the supplemental information table 23 is detected at the supplement start time judging step S33 in the supplemental data playback step, instead of the recording at the playback stop position recording step S34 in FIG. 6, immediately after the fact that the transport_error_indicator bit is at 1 (indicative of an existence of a bit error) is detected at the error judging step S2 in the supplemental information table generating step shown in FIG. 3, a destination to which the data being recorded in the recording/playback apparatus 18 is written is recorded at the playback stop position 43 shown in FIG. 11, at the recording stop position recording step S51 shown in FIG. 10.

The process when the fact that the transport_error_indicator bit is not at 1 (indicative of non-existence of a bit error) is detected at the error judging step S2 in the supplemental information table generating process is carried out as shown in FIG. 3. If the fact that the transport_error_indicator bit is at 1 (indicative of an existence of a bit error) is detected at the error judging step S2 in the supplemental information table generating process, before the process for storing the time information (PTS/DTS) of the transport stream, which was recorded in the time information 34 and inputted finally and normally, in the supplement start time column 35 of the supplemental information table 23 at the supplement start time recording step S11, the position information with regard to the destination of the recording/playback apparatus 18 to which the data currently being recorded is written is stored in the playback stop position 43 of the transmission at the recording stop position recording step S51.

Due to the series of the processes shown in FIG. 10, after the playback stop position information 43 after the stop of the recording of the data to the recording/playback apparatus 18 is stored at the playback stop position 43 of the supplemental information table 23 in the system memory 22, if the input of the playback is performed on the input device 14 shown in FIG. 2, the system controller 12 carries out the playback process from the recording/playback apparatus 18. As shown in FIG. 12, the usual playback from the recording/playback apparatus 18 is carried out at the playback step S31. Then, if the fact that the data being played back at the playback step S31 is the supplemental data is detected at the supplement operation judging step S32, when the fact that the time information (PTS/DTS) of the data being played back coincides with the supplement start time 19 of the supplemental information table 23 is detected at the supplement start time judging step S33, the read out position of the playback data is changed to the record position 39 of the supplemental information table 23 at the playback switching step S35. Then, the sequence returns back to the playback step S31.

If the data being played back at the playback step S31 is the supplemental data at the supplement operation judging step S32, when the fact that the time information (PTS/DTS) of the data being played back coincides with the supplement end time 21 of the supplemental information table 23 is detected at the supplement end time judging step S36, the read out position of the data being played back is changed to the playback stop position 43 that is the member of the supplemental information table 23 in the system memory 22, at the playback changing step S37. Then, the sequence returns back to the playback step S31.

The processes in the case when the time information (PTS/DTS) of the data being played back does not coincide with the supplement end time 21 of the supplemental information table 23 at the supplement end time judging step S36 and the case when the time information (PTS/DTS) of the data being played back does not coincide with the supplement start time 19 of the supplemental information table 23 at the supplement start time judging step S33 are equal to the process shown in FIG. 6.

The multiplexing digital broadcast method according to the present invention can improve the broadcast efficiency in the broadcast of the digital data except the original broadcast program. In particular, it can improve the re-broadcast service of the data that could not be demodulated. Since the broadcast of the digital data except the original broadcast program is multiplexed, the broadcast efficiency can be further improved.

As the actual first effect, the broadcast program can be played back from the recording/playback apparatus without any loss of the broadcast content, except the case when most of the broadcast program is lost as the statistical result in all users, even if the user of the digital broadcast receiver having the recording/playback apparatus can not receive the broadcast electric wave because of the influences of the weather condition and the like and it is recorded under a condition that a part of the recorded program is lost. At present, as electric wave bands to be assigned to one station in BS and CS digital broadcasts, correspond to about 10 channels. The bands actually being used correspond to about 7 channels. Thus, the present invention is effective even if a maximum of about 30% of the program is lost.

As the actual second effect, when a viewer, namely, a client fails in the recording of a part of the broadcast program and if a broadcasting dealer tries to insure it, only the lost part can be divided in the multiplexing stream and then transmitted. Thus, it is possible to reduce the band of the stream necessary for the insurance. If about 30% of the entire program is insured within the same time as the broadcast time of the entire program, it is sufficient that the broadcasting dealer only reserves about 30% of the assigned band.

What is claimed is:

1. A multiplexing digital broadcast system comprising a receiving terminal and a broadcasting station, wherein said receiving terminal includes:

a receiving side recording device configured to demodulate a specification digital data selectively specified from a multiplexing digital data transmitted by said broadcasting station to record;

a receiving side table configured to record a position in a data string corresponding to a data unit of said specification digital data in which a demodulation ended in failure; and a communicating device configured to transmit said position in said data string to said broadcasting station, and wherein said broadcasting station includes:

a broadcasting station side recording device configured to record an original data corresponding to said multiplexing digital data; and a supplemental data transmitting device configured to extract said specification digital data corresponding to said position in said data string from said original data and to transmit to said receiving terminal, and wherein said broadcasting station multiplexes said supplemental data with said multiplexing digital data.

2. The multiplexing digital broadcast system according to claim 1, wherein said supplemental data transmitting device multiplexes said specification digital data to retransmit.

3. The multiplexing digital broadcast system according to claim 1, wherein said receiving terminal further includes:

an input device through which a receiving side user inputs a signal, and wherein said signal includes:

a signal to play back said specification digital data recorded on said receiving side recording device; and a selection signal to select said specification digital data.

4. The multiplexing digital broadcast system according to claim 1, wherein said position in said data string corresponds to a timing position, and said timing position is noted on said receiving side table.

5. The multiplexing digital broadcast system according to claim 4, wherein said timing position includes a start time when a supplement starts with a supplemental data that comprises said specification digital data transmitted from said supplemental data transmitting device and an end time when said supplement ends with said supplemental data.

6. The multiplexing digital broadcast system according to claim 1, wherein said receiving terminal further includes:

an input device through which a receiving side user inputs a signal, wherein said signal is selected from a group which includes:

a signal to play back said specification digital data recorded on said receiving side recording device;

a selection signal to select said specification digital data; and a transmission start signal to start a transmission of a supplemental data that comprises said specification digital data transmitted from said supplemental data transmitting device, and wherein said broadcasting station sends said supplemental data based on said transmission start signal.

7. The multiplexing digital broadcast system according to claim 1, wherein said receiving side table records said position in said data string of said specification digital data in which said demodulation ended in failure as a playback stop position to stop playing back a data recorded on said receiving side recording device.

8. The multiplexing digital broadcast system according to claim 7, wherein said receiving side table records a record position of a data recorded on said receiving side recording device to play back a supplemental data that comprises said specification digital data transmitted from said supplemental data transmitting device instead of playing back said data recorded on said receiving side recording device.

9. The multiplexing digital broadcast system according to claim 7, wherein said timing position includes a start time when a supplement starts with a supplemental data that comprises said specification digital data transmitted from said supplemental data transmitting device and an end time when said supplement ends with said supplemental data, and wherein, when a timing information of a played back one of said data recorded on said receiving side recording device which is not a supplemental data that comprises said specification digital data transmitted from said supplemental data transmitting device corresponds to said end time, a read out position of said played back one is changed to said playback stop position.

10. The multiplexing digital broadcast system according to claim 1, wherein said receiving side table records a record position of a data recorded on said receiving side recording device to play back a supplemental data that comprises said specification digital data transmitted from said supplemental data transmitting device instead of playing back said data recorded on said receiving side recording device.

11. The multiplexing digital broadcast system according to claim 10, wherein said timing position includes a start time when a supplement starts with a supplemental data that comprises said specification digital data transmitted from said supplemental data transmitting device and an end time when said supplement ends with said supplemental data, and wherein, when a timing information of a played back one of said data recorded on said receiving side recording device which is not a supplemental data that comprises said specification digital data transmitted from said supplemental data transmitting device corresponds to said start time, a read out position of said played back one is changed to said record position.

12. The multiplexing digital broadcast system according to claim 1, wherein said specification digital data comprises digital audiovisual data.

13. The multiplexing digital broadcast system according to claim 1, wherein said specification digital data comprises Mpeg-ts (ISO/IEC 13818-1).

14. A multiplexing digital broadcast method, comprising:

demodulating a specification digital data selectively specified from a multiplexing digital broadcast data broadcasted by a broadcasting station on a receiving terminal to record;

recording a position in a data string of said specification digital data in which said demodulating ended in failure on said receiving terminal;

communicating said position in said data string to said broadcasting station; and retransmitting said specification data corresponding to said position in said data string to said receiving terminal by multiplexing said specification digital data with said multiplexing digital broadcast data broadcast by said broadcasting station.

15. The multiplexing digital broadcast method according to claim 14, wherein said retransmitting includes:

extracting from a data received by said broadcasting station said specification digital data corresponding to said position in said data string transmitted from said receiving terminal;

adding an ID to specify said receiving terminal and an ID to specify said specification digital data;

inserting said specification digital data into a frequency band of said multiplexing digital broadcast data; and multiplexing said specification digital data with said multiplexing digital broadcast data for retransmitting.

16. A component for a multiplex digital broadcast system, said component comprising one of:

a receiving terminal comprising:

a receiving side recording device demodulating a specification digital data selectively specified from a multiplexing digital data transmitted by a broadcasting station to record;

a receiving side table recording a position in a data string corresponding to a data unit of said specification digital data in which a demodulation ended in failure; and a communicating device transmitting said position in said data string to said broadcasting station, and a broadcasting station comprising:

a broadcasting station side recording device recording an original data corresponding to said multiplexing digital data; and a supplemental data transmitting device:

extracting a supplemental data comprising a specification digital data corresponding to said position in said data string from said original data; and transmitting said supplemental data, wherein said broadcasting station multiplexes said supplemental data with said multiplexing digital data.

* * * * *